US005270510A

United States Patent [19]

Aoki et al.

[11] Patent Number: 5,270,510

[45] Date of Patent: Dec. 14, 1993

[54] MICROWAVE OVEN

[75] Inventors: Masayuki Aoki, Inuyama; Nobuaki Ohta, Anjo, both of Japan

[73] Assignee: Kabushiki Kaisha Toshiba, Kawasaki, Japan

[21] Appl. No.: 915,073

[22] Filed: Jul. 16, 1992

[30] Foreign Application Priority Data

Aug. 26, 1991 [JP] Japan ..... 3-213323
Dec. 10, 1991 [JP] Japan ..... 3-325581

[51] Int. Cl.[5] ..... H05B 6/68

[52] U.S. Cl. ..... 219/10.55 B; 219/10.55 R; 219/10.77; 99/325; 367/139; 363/55; 336/180

[58] Field of Search ..... 219/10.55 B, 10.55 F, 219/10.55 M, 10.55 E, 10.77, 10.55 R, 506; 424/DIG. 10, 16; 367/139; 99/325; 363/55; 336/180

[56] References Cited

U.S. PATENT DOCUMENTS 4,439,415 3/1984 Hennart et al. ..... 424/16
4,518,839 5/1985 Taguchi et al. ..... 219/10.55 B
4,562,561 12/1985 Ackley ..... 367/139
4,785,152 11/1988 Hirata et al. ..... 219/10.55 B
4,888,461 12/1989 Takano et al. ..... 219/10.55 B
4,920,246 4/1990 Aoki ..... 219/10.55 B
4,999,818 3/1991 Malleolo ..... 367/139

*Primary Examiner*—Bruce A. Reynolds
*Assistant Examiner*—Tu Hoang
*Attorney, Agent, or Firm*—Limbach & Limbach

[57] ABSTRACT

A microwave oven includes a magnetron generating microwaves which are irradiated onto food for heating the same, a circuit substrate incorporating an electric circuit for driving and controlling the magnetron, circuit means for generating both an electrical alarming signal and a high-frequency electrical signal, and a sound producer producing an alarming sound regarding a heating operation when supplied with the alarming electrical signal and producing ultrasonic waves for the repelling of insects when supplied with the high-frequency electrical signal.

4 Claims, 9 Drawing Sheets

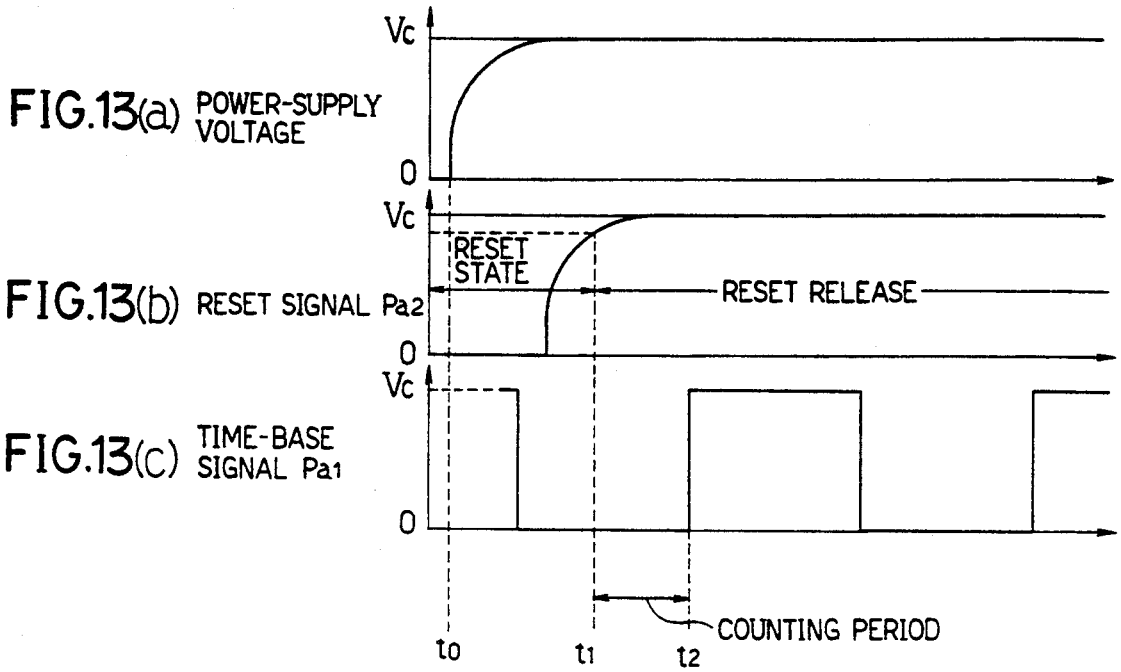
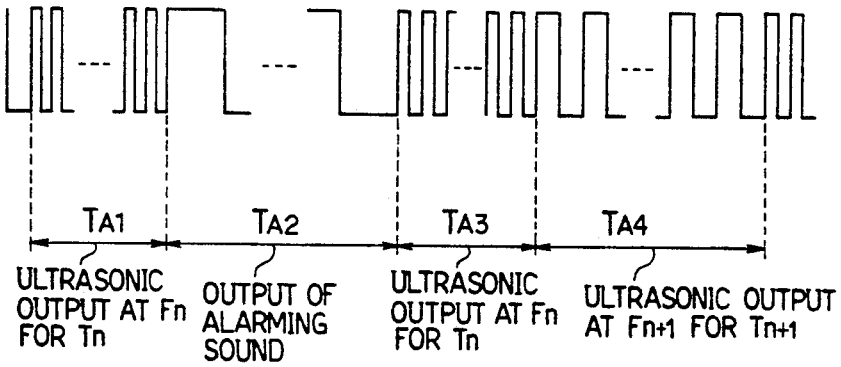
FIG.14

MICROWAVE OVEN

BACKGROUND OF THE INVENTION

1. Field of the invention

This invention relates to a microwave oven having a magnetron generating microwaves which are irradiated onto food for heating and cooking it, and more particularly to such a microwave oven wherein a control circuit for the heating operation is provided on a substrate.

2. Description of the prior art

Generally, microwave ovens comprise a magnetron for generating microwaves and a substrate of electronic circuitry including a control circuit for controlling the magnetron. The control circuit is composed of a microcomputer-based electronic circuit in addition to a power transformer, a power circuit and the like.

The power transformer and the power circuit are normally in an on-state. Upon receipt of a key-input for the cooking, the microcomputer controls the magnetron so that it is energized and deenergized in accordance with a program previously stored in it, whereby food contained in a heating chamber is heated.

Some amount of heat is generated by the power transformer and the power circuit since they are normally in the on-state, as described above. Accordingly, the temperature in the vicinity of the substrate of the electronic circuitry is higher than the room temperature. Such an environment provides for a good place for insects breeding in a kitchen, for example, cockroaches, to inhabit.

On the other hand, a number of openings or holes such as cooling louvers are formed in walls of the casing of the microwave oven so that parts enclosed in the casing, such as the magnetron and the high-voltage transformer are cooled. These openings give access to the interior of the casing for the insects such as the cockroaches, which intensifies the tendency for the insects to inhabit the casing interior of the microwave oven.

When the insects such as the cockroaches invade and inhabit the casing interior, particularly, the portion of the casing interior where the substrate of the electronic circuitry is disposed, the substrate is polluted by waste matters excreted from the insects or dead bodies of the insects. These waste matters or dead bodies of the insects cause failure in insulation in electrical parts composing the electronic circuitry and the like. Furthermore, the electrical parts are capacitive-coupled by the waste matters or the dead bodies of the insects. Consequently, the waste matters and the dead bodies of the insects become the cause for malfunction and failure of the microwave oven.

To overcome the above-described deficiency, some countermeasures have been proposed in the prior art. For example, one countermeasure is to close paths through which the insects invade the interior of the microwave oven. Another countermeasure is to cover the portion of the substrate of the electronic circuitry. However, the changes in the mechanical construction resulting from these countermeasures creates additional cost, resulting in increase in the cost of the microwave oven.

SUMMARY OF THE INVENTION

Therefore, an object of the present invention is to provide a microwave oven wherein the insects such as cockroaches can be prevented from invading its interior by a simple and inexpensive construction and accordingly, occurrence of the malfunction or failure due to pollution of the circuit substrate by the insects can be prevented.

The present invention provides an improved microwave oven comprising a magnetron generating microwaves which are irradiated onto food for heating the same, a circuit substrate incorporating an electric circuit for driving and controlling the magnetron, the electric circuit including a microcomputer, circuit means for generating both an electrical alarming signal and a high-frequency electrical signal, and a sound producer producing an alarming sound regarding a heating operation when supplied with the electrical alarming signal and producing ultrasonic waves for the repelling of insects when supplied with the high-frequency electrical signal.

It is preferable that the microwave oven further comprise control means for controlling the sound producer so that the high-frequency electrical signal is generated by the sound producer while generation of the alarming electrical signal is interrupted.

The sound producer may comprise a resonant cavity for the alarming sound and another resonant cavity for the ultrasonic waves, the cavities being separate from each other.

The microwave oven may further comprise time-base signal generating means for generating a time-base signal supplied to the microcomputer so that a clock function of the microcomputer is fulfilled, reset signal generating means for generating a reset signal so that the microcomputer is put into a reset-release state in association with power supply to the microcomputer, count means for counting pulses generated at predetermined intervals in the microcomputer, control means for starting a counting operation of the count means in response to the reset signal and interrupting the counting operation when a voltage level of the time-base signal is switched after generation of the reset signal, and selecting means for selecting a value of the frequency of the high-frequency electrical signal in accordance with a counted value of the count means.

The ultrasonic waves are produced from the sound producer during the alarming operation regarding the heating operation and during the period other than the period of the alarming operation. The ultrasonic waves produced by the sound producer have a range of frequency offensive to the insects such as the cockroaches. The above-described arrangement can provide circumstances in which the insects cannot invade the interior of the microwave oven. Consequently, the insects can be prevented from invading the interior of the microwave oven and inhabiting the vicinity of the substrate of the electronic circuitry provided in the control circuit of the microwave oven even though the microwave oven has the construction that the insects can invade the interior of the microwave oven easily. The present invention thus achieves an effect that occurrence of malfunction or failure of the microwave oven due to pollution of the circuit substrate by the insects can be prevented by the simple and cost effective arrangement.

When the sound producer comprises the separate resonant cavities for the alarming sound and the ultrasonic waves respectively, these sound waves can be efficiently produced.

When the frequencies of the ultrasonic waves produced from the sound producer is randomly varied, the insects such as the cockroaches can be prevented from being gradually inured to the ultrasonic waves at a single frequency. Consequently, the above-described effect of preventing the insects from invading the interior of the microwave oven can be further improved.

Other objects of the present invention will become obvious upon understanding of the illustrative embodiments about to be described. Various advantages not referred to herein will occur to one skilled in the art upon employment of the present invention in practice.

BRIEF DESCRIPTION OF THE DRAWINGS

Several embodiments of the invention will be described with reference to the accompanying drawings in which:

FIG. 13(*a*) through 13(*c*) are time charts explaining a power supply voltage, a reset signal and time-base signal when the electrical power is supplied to the microwave oven; and FIG. 14 is a waveform chart of an electrical signal supplied to the buzzer.

DESCRIPTION OF THE PREFERRED EMBODIMENTS

Figure 1:
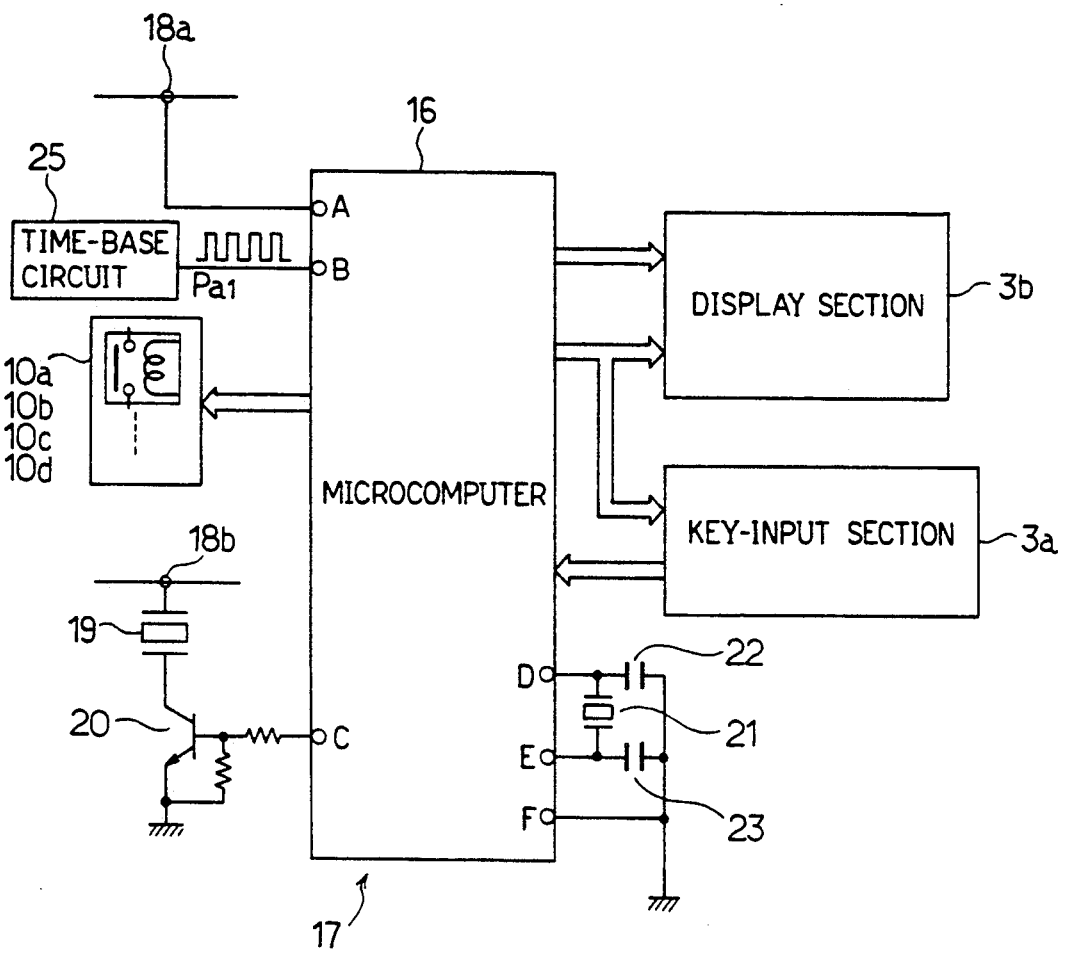
FIG. 1 is a block diagram showing an electrical arrangement of the microwave oven in accordance with a first embodiment of the present invention.

A first embodiment of the present invention will be described with reference to FIGS. 1 through 8. Referring first to FIG. 3, a casing 1 of the microwave oven includes a door 2 mounted on the front opening thereof. An operation panel 3 is also provided in the front side of the casing 1. A number of openings 4 serving as cooling louvers are formed in a side wall of the casing 1. As shown in FIG. 1, the operation panel 3 includes a key-input section 3*a* and display section 3*b*.

Figure 2:
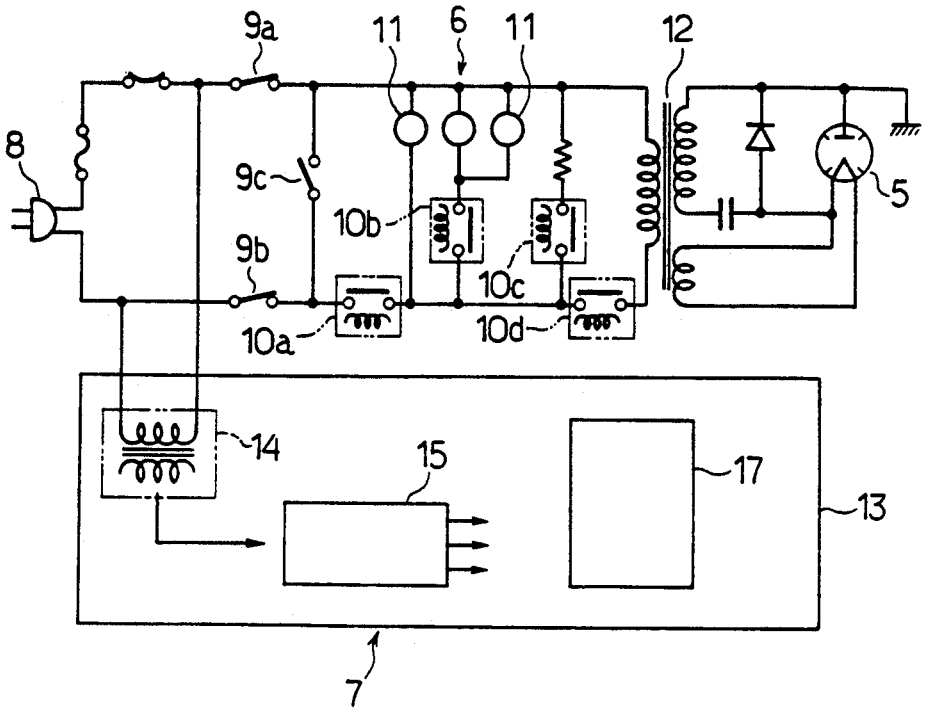
FIG. 2 is a circuit diagram showing an overall electrical arrangement of the microwave oven.
Figure 3:
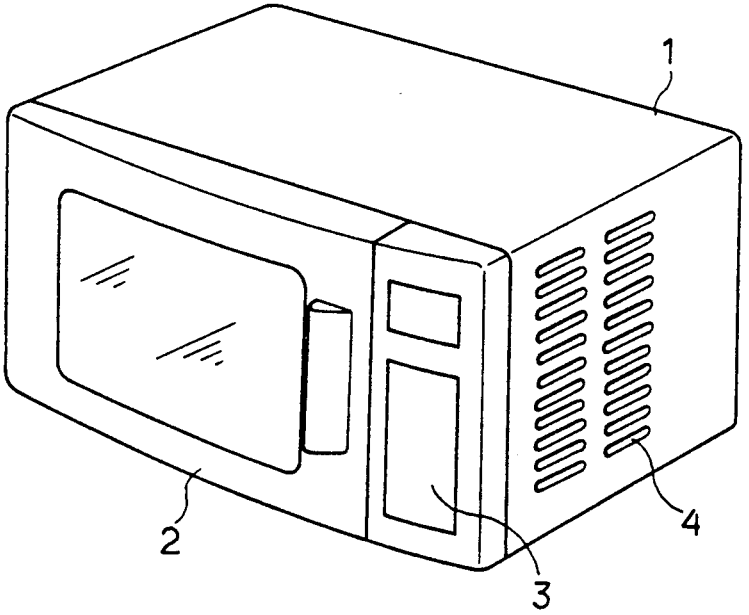
FIG. 3 is a perspective view of the microwave oven.

Referring to FIG. 2, a magnetron 5 is energized by a main circuit 6 and a control circuit 7 is provided for controlling the main circuit 6. In the main circuit 6, a power-supply plug 8 to be connected to an AC power supply is further connected to a primary winding of a high-voltage transformer 12 through door switches 9*a* to 9*c*, various relays 10*a* to 10*d*, applied loads 11 such as a fan motor. The relays 10*a*–10*d* are on-off controlled by the control circuit 7. A secondary winding of the high-voltage transformer 12 is connected to the magnetron 5 through a capacitor, a diode and the like.

The control circuit 7 is provided on a substrate of electronic circuitry 17. A primary voltage from the power-supply plug 8 is applied to a primary side of a power transformer 14 and a secondary output voltage is applied, as a DC power-supply voltage, through a DC power-supply circuit 15 to the electronic circuitry 17 including a microcomputer 16.

Referring to FIG. 1 showing an electrical arrangement of the electronic circuitry 17, a power input terminal A of the microcomputer 16 is connected to a power supply terminal 18*a*. A time-base input terminal B of the microcomputer 16 is connected to a time-base circuit 25. The time-base circuit 25 is arranged to generate a pulse signal $P_{a1}$ in accordance with a frequency of the AC power supply. Based on the pulse signal $P_{a1}$, the microcomputer 16 performs the timing operation.

Figure 4:
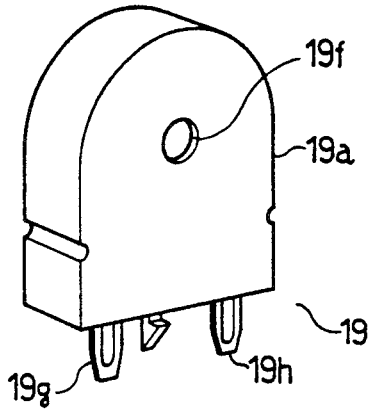
FIGS. 4 and 5 are perspective views of a buzzer employed in the microwave oven, the views taken from different viewing angles.
Figure 5:
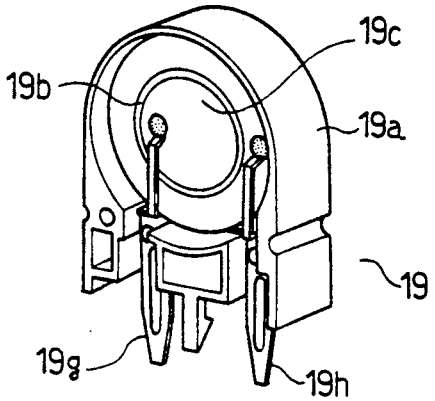
Figure 6:
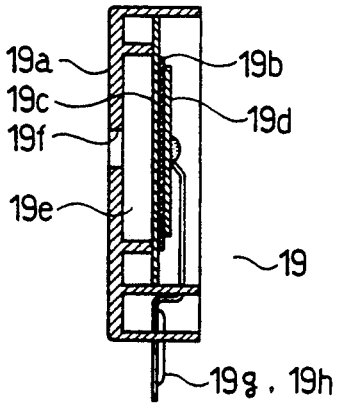
FIG. 6 is a longitudinally section side view of the buzzer.

A buzzer 19 serving as a sound producer is supplied with the electrical power from a DC power terminal 18*b*. A drive transistor 20 is connected in series to the buzzer 19 for controlling it so that it is energized and deenergized. The drive transistor 20 has the base connected to a buzzer output terminal C of the microcomputer 16. As shown in FIGS. 4–6, the buzzer 19 comprises a body 19*a* and a piezoelectric ceramic plate 19*b* mounted on the body 19*a* and electrode plates 19*c* and 19*d* mounted on the piezoelectric ceramic plate 19*b*. A space defined between the body 19*a* and the piezoelectric ceramic plate 19*b* serves as a resonant cavity 19*e*. When a pulse voltage is applied across the electrode plates 19*c*, 19*d* through respective terminals 19*g* and 19*h*, the piezoelectric ceramic plate 19*b* oscillates at an oscillation frequency in accordance with the frequency of the applied pulse voltage, whereby the oscillation is resonated in the resonant cavity 19*e* and a sound is produced from an opening 19*f*.

Connection terminals D and E of the microcomputer 16 are connected to respective terminals of an oscillator 21 generating reference clock signals. The terminals D, E are grounded through respective capacitors 22 and 23. A ground terminal F of the microcomputer 16 is also grounded. The microcomputer 16 and the oscillator 21 compose an oscillation circuit to generate reference clock signals at a predetermined frequency. The microcomputer 16 has a built-in counter so that a pulse signal is generated every time a predetermined number of reference clock signals is counted.

Figure 7:
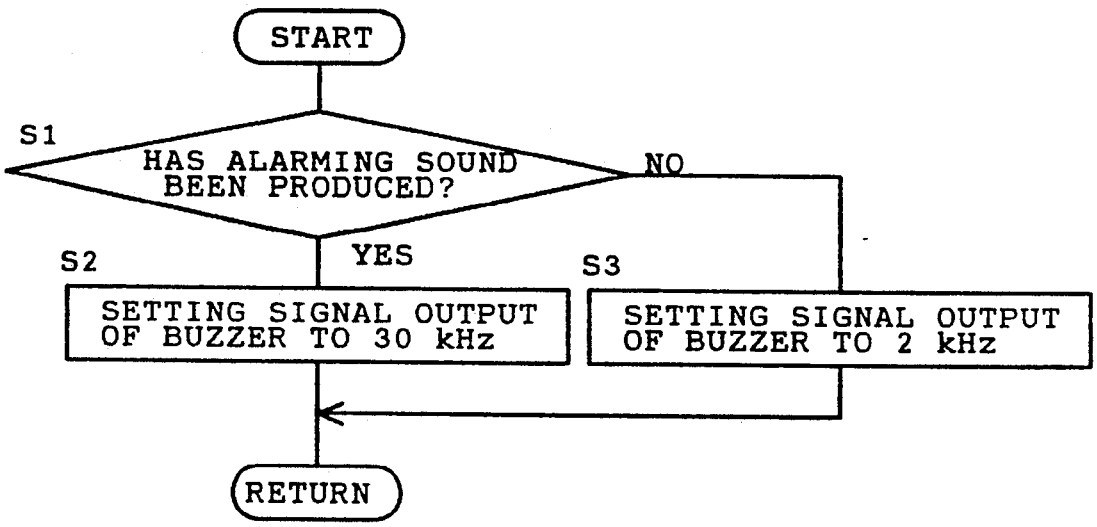
FIG. 7 is a flowchart explaining the operation of the buzzer.
Figure 8:
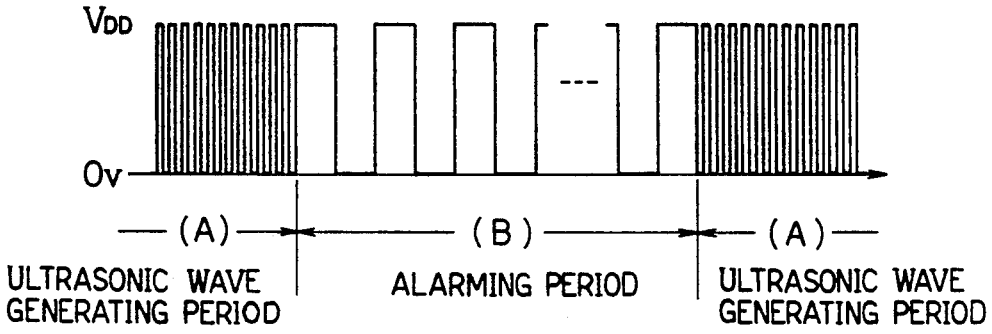
FIG. 8 is a time chart showing a buzzer drive signal.

The operation of the microwave oven will be described. The microcomputer 16 is supplied with an operating voltage through the power transformer 14 at the side of the control circuit 7 and the DC power circuit 15 in the condition that the electrical power is being supplied from the AC power supply to the microwave oven. The microcomputer 16 executes processing in accordance with a main program (not shown) for the heating operation. On this occasion, the microcomputer 16 also executes a buzzer-driving program as shown in FIG. 7. That is, the microcomputer 16 determines whether or not the buzzer 19 needs to produce an alarming sound to inform of completion of the heating operation, at step S1. Determining that the alarming sound need not be produced, in this case, the microcomputer 16 advances to step S2. In step S2, the frequency of the pulse signal or high-frequency electrical signal for driving the buzzer 19 is set to 30 kHz. More specifically, the number of counted reference clocks is set as described above. A pulse is generated every time the set number of reference clocks is counted up, thereby generating the buzzer-driving pulse signal at the frequency of 30 kHz.

Upon return to the main program, the microcomputer 16 generates the buzzer-driving pulse signal at the above-described frequency at an output terminal C, thereby turning the transistor 20 on and off. See period (A) in FIG. 8. Consequently, the voltage at the frequency of 30 kHz from the dc power supply terminal 18c is applied to the buzzer 19, which produces ultrasonic waves at 30 kHz.

It has been found that the ultrasonic waves produced from the buzzer 19 are not audible for the human beings but would be offensive to the insects such as the cockroaches. Accordingly, the cockroaches and the like keep away from the vicinity of the devices incorporated in the microwave oven during production of the ultrasonic waves from the buzzer 19. The microcomputer 16 is on standby for a key-input in the condition that the ultrasonic waves are being produced from the buzzer 19. Upon receipt of the key-input, the microcomputer 16 controls the relays 10a–10d of the main circuit 6 to drive the magnetron 5 in accordance with the main program, so that the predetermined heating operation is performed.

The electrical alarming signal is supplied to the buzzer 19 during execution of the heating operation or at the time of completion of the heating operation so that the alarming sound is produced from the buzzer 19. Then, the microcomputer 16 executes the buzzer driving program as shown in FIG. 7 again. That is, the microcomputer 16 determines that the alarming sound needs to be produced, at step S1, advancing to step S3. In step S3, the frequency of the pulse signal for driving the buzzer 19 is set to 2 kHz. The microcomputer 16 then returns to the main program. The microcomputer 16 controls the buzzer 19 in accordance with the main program so that the voltage at the frequency of 2 kHz is applied to the buzzer 19, whereby the alarming sound is produced from the buzzer 19 to inform the user of the completion or initiation of the heating operation. Upon completion of the alarming operation, the microcomputer 16 again executes the buzzer-driving program so that the ultrasonic waves are produced from the buzzer 19.

In accordance with the above-described embodiment, the buzzer 19 is supplied with the pulse signal at the frequency of 30 kHz while the alarming operation is not performed by the buzzer 19, so that the ultrasonic waves are generated. Consequently, the ultrasonic waves can be generated for almost all the period for which the power supply is effective. Thus, the generation of the ultrasonic waves offensive to the insects such as the cockroaches can prevent the electronic circuit substrate in the microwave oven from being polluted by the insects. Accordingly, the reduction in the occurrence of the malfunction or failure of the microwave oven can be achieved by the simple and cost-effective arrangement.

Figure 9:
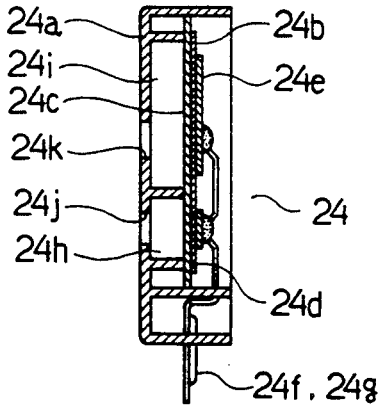
FIG. 9 is a longitudinally sectional side view of the buzzer employed in the microwave oven of a second embodiment.

FIG. 9 shows a second embodiment of the invention. The buzzer 24 employed in the microwave oven of the second embodiment comprises the body 24a, the piezoelectric ceramic plate 24b mounted on the body 24a, the electrode plate 24d for the ultrasonic waves, the electrode plate 24e for the alarming sound and a common electrode plate 24c, these electrode plates being provided on the piezoelectric ceramic plate 24b. The voltage from the terminals 24f and 24g is applied commonly to these electrode plates. The body 24a has both a resonant cavity 24h for the ultrasonic waves and a resonant cavity 24i for the alarming sound, the cavities being positioned behind the body 24a. Openings 24j and 24k are formed in the respective resonant cavities 24h, 24i.

In accordance with the second embodiment, the piezoelectric ceramic plate 24b of the buzzer 24 is vibrated so that the ultrasonic waves are generated, when the pulse signal at the frequency of 30 kHz is generated by the microcomputer 16. In this case the vibration in the resonant cavity 24h for the ultrasonic waves is mainly resonated efficiently such that the resultant ultrasonic waves are produced from the opening 24j. On the other hand, when the pulse signal for the alarming sound is generated by the microcomputer 16, the vibration in the resonant cavity 24i for the alarming sound is mainly resonated efficiently such that the alarming sound is produced from the opening 24k. The resonant cavities 24h and 24i thus act effectively in accordance with the respective ultrasonic waves and frequency of the alarming sound to be produced. Consequently, a larger sound output can be obtained than in the case of a single resonant cavity.

Although the oscillation frequency of the ultrasonic wave is set to 30 kHz in the foregoing embodiments, it may take a value of any oscillation frequencies at which the ultrasonic waves are not audible to the ears of the human beings but at which the insects such as the cockroaches keep away from the vicinity of the devices incorporated in the microwave oven.

Figure 10:
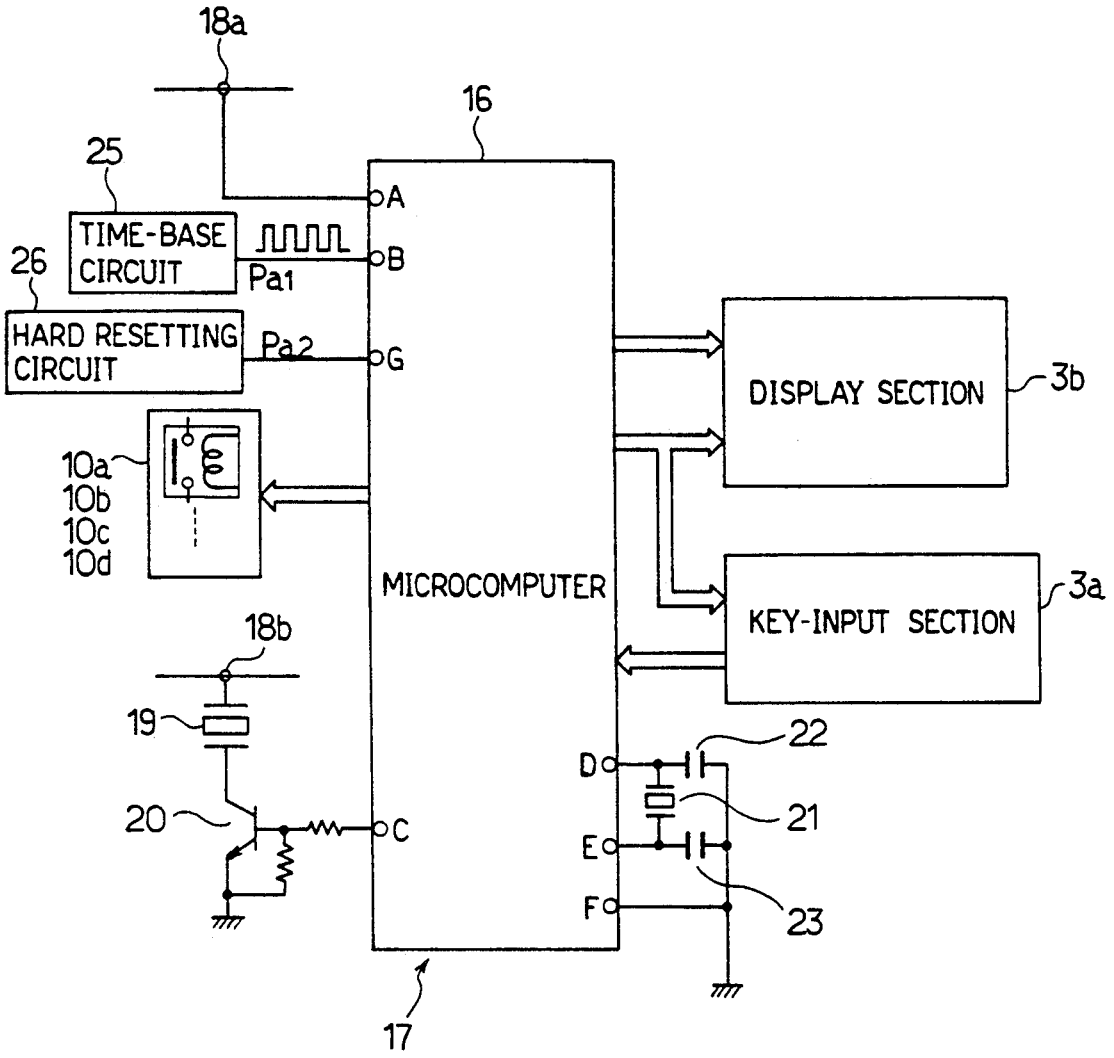
FIG. 10 is a view similar to FIG. 1 showing a third embodiment.

FIGS. 10 through 14 illustrate a third embodiment of the invention. Difference between the first and third embodiments will be described. Referring to FIG. 10 showing an overall electrical arrangement of the microwave oven, a hard resetting circuit 26 has an output terminal connected to the input terminal G of the microcomputer 16. The hard-resetting circuit 26 supplies the microcomputer 16 with a reset signal $P_{a2}$ at an initial stage of the operation following the power supply, thereby holding the microcomputer 16 at the reset state so that the program is not started in the condition that the power-supply voltage to the microcomputer is unstable.

The microcomputer 16 is provided with a counting function. The microcomputer 16 performs a counting operation based on reference clocks upon completion of an initializing processing after the start of the program, as will be described later. Furthermore, the microcomputer 16 is provided with a storage section (not shown) for previously storing data of values of frequency $F_n$ and time period $T_n$ corresponding to a count value n obtained as the result of the counting operation, as shown in the following TABLE 1:

TABLE 1

| COUNT NUMBER | FREQUENCY $F_n$ | TIME PERIOD $T_n$ | COUNT NUMBER | FREQUENCY $F_n$ | TIME PERIOD $T_n$ |
|---|---|---|---|---|---|
| 1 | $F_1$ = 25 kHz | $T_1$ = 50 H | 2 | $F_2$ = 39 kHz | $T_2$ = 58 H |
| 3 | $F_3$ = 33 kHz | $T_3$ = 73 H | 4 | $F_4$ = 26 kHz | $T_4$ = 91 H |
| 5 | $F_5$ = 28 kHz | $T_5$ = 82 H | 6 | $F_6$ = 37 kHz | $T_6$ = 67 H |
| 7 | $F_7$ = 22 kHz | $T_7$ = 34 H | 8 | $F_8$ = 31 kHz | $T_8$ = 76 H |

TABLE 1-continued

| COUNT NUMBER | FREQUENCY $F_n$ | TIME PERIOD $T_n$ | COUNT NUMBER | FREQUENCY $F_n$ | TIME PERIOD $T_n$ |
|---|---|---|---|---|---|
| 9 | $F_9$ = 38 kHz | $T_9$ = 51 H | 10 | $F_{10}$ = 35 kHz | $T_{10}$ = 92 H |
| 11 | $F_{11}$ = 25 kHz | $T_{11}$ = 31 H | 12 | $F_{12}$ = 29 kHz | $T_{12}$ = 60 H |
| 13 | $F_{13}$ = 34 kHz | $T_{13}$ = 41 H | 14 | $F_{14}$ = 23 kHz | $T_{14}$ = 27 H |
| 15 | $F_{15}$ = 35 kHz | $T_{15}$ = 59 H | 16 | $F_{16}$ = 31 kHz | $T_{16}$ = 18 H |
| 17 | $F_{17}$ = 28 kHz | $T_{17}$ = 26 H | 18 | $F_{18}$ = 23 kHz | $T_{18}$ = 88 H |
| 19 | $F_{19}$ = 39 kHz | $T_{19}$ = 53 H | 20 | $F_{20}$ = . . . | $T_{20}$ = . . . |
| 21 | . . . | . . . | . . . | . . . | . . . |

In TABLE 1, the values of frequency $F_n$ and time period $T_n$ corresponding to count value n are determined based on a table of pseudo-random numbers. The values of frequency $F_n$ at which the generated ultrasonic waves are offensive to the insects are randomly set in a range of 22 kHz to 40 kHz and the values of time period $T_n$ are randomly set in a range of 10 hours to 100 hours, as shown in TABLE 1, for example.

In accordance with the third embodiment, when the electrical power is supplied to the microwave oven or when the plug 8 is connected to a plug socket at time $t_0$, the power-supply voltage is applied to the power-supply input terminal A of the microcomputer 16 and a time-base signal $P_{a1}$ is supplied from the time-base circuit 25 to the time-base input terminal B of the microcomputer 16, as is shown in FIG. 13. Subsequently, the hard-resetting circuit 26 releases the microcomputer 16 from the reset signal $P_{a2}$ supplied to the reset terminal G thereof when a predetermined period of time has elapsed, whereby the microcomputer 16 is rendered operable. The microcomputer 16 is thus maintained in the reset state for the period between time $t_0$ and time $t_1$ by the reset signal $P_{a2}$ so that the program is prevented from being executed in the condition that the power-supply voltage is unstable after the power supply. Consequently, the malfunction of the microwave oven can be prevented.

Figure 11:
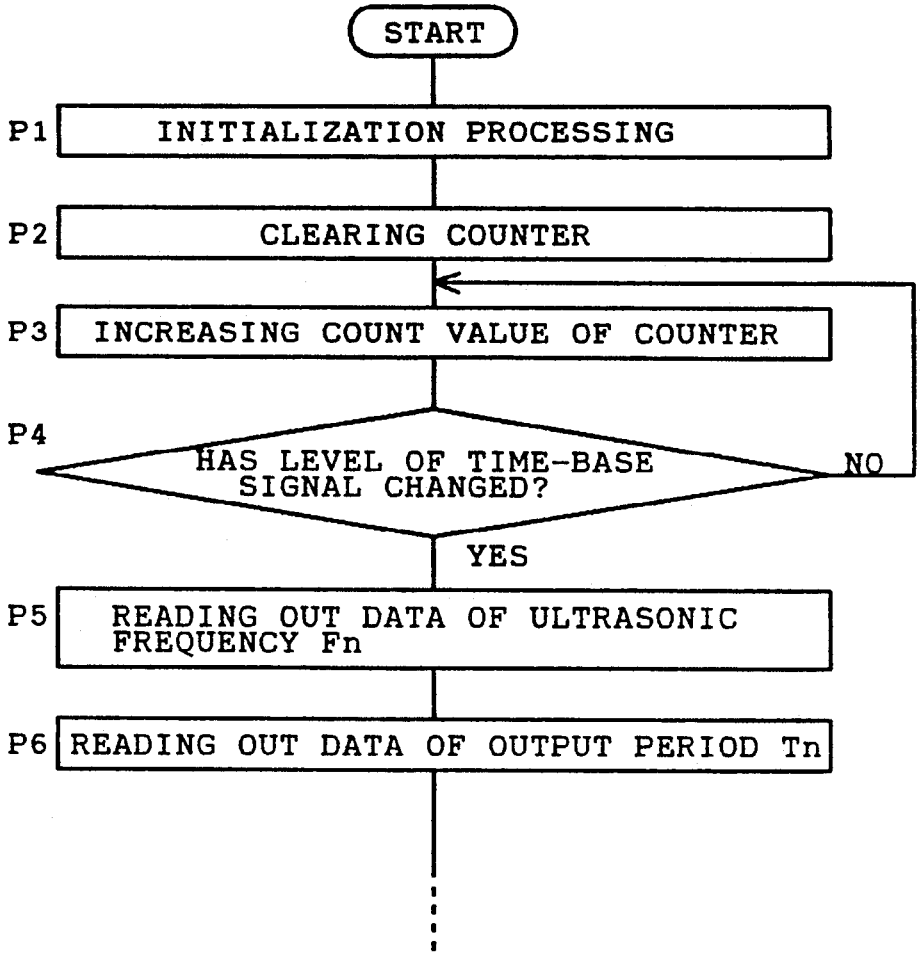
FIG. 11 is a flowchart explaining an operation for randomly selecting the frequency of the ultrasonic waves in the third embodiment.

The microcomputer 16 then initiates its operation in accordance with the program shown in FIG. 11. More specifically, the microcomputer 16 executes an initializing processing at step P1 and clears up the count value n of the counter at step P2, starting the counting operation at time $t_1$ in FIG. 13.

Subsequently, the microcomputer 16 operates to increase the count value of the counter by 1 at step P3, advancing to step P4. The microcomputer 16 determines whether or not the level of the time-base signal $P_{a1}$ at the time-base input terminal B has changed from the level at time $t_1$ of start of the program. Determining that the level of the time-base signal $P_{a1}$ has not changed, the microcomputer 16 returns to step P3 to increase the count value of the counter. The microcomputer 16 advances to step P5 when it determines that the level of the signal $P_{a1}$ has changed (time $t_2$). Consequently, the counter counts the pulses for the time period between time $t_1$ and time $t_2$ and the microcomputer 16 responds so that the operation of step P4 is performed only for an initial level change (change to the level at time $t_2$) of the time-base signal $P_{a1}$.

Determining at step P4 that the level of the signal $P_{a1}$ has changed, the microcomputer 16 reads out data of the frequency $F_n$ and time period $T_n$ corresponding to the count value previously stored based on the count value n of the counter and sets these values at steps P5 and P6 respectively. For example, when the count value of the counter is "7", data of frequency $F_7$=22 kHz and data of time period $T_7$=34 H are read out from TABLE 1. In this case the count value n of the counter corresponds to a time period between the time of the clearing of the counter and the time of the initial inversion of the time-base signal. Accordingly, the count value n of the counter is randomly set to a different value every time the electrical power is supplied to the microwave oven or the plug 8 is connected to the plug socket. Consequently, the values of frequency $F_n$ and time period $T_n$ are randomly set at the respective steps P5 and P6.

Figure 12:
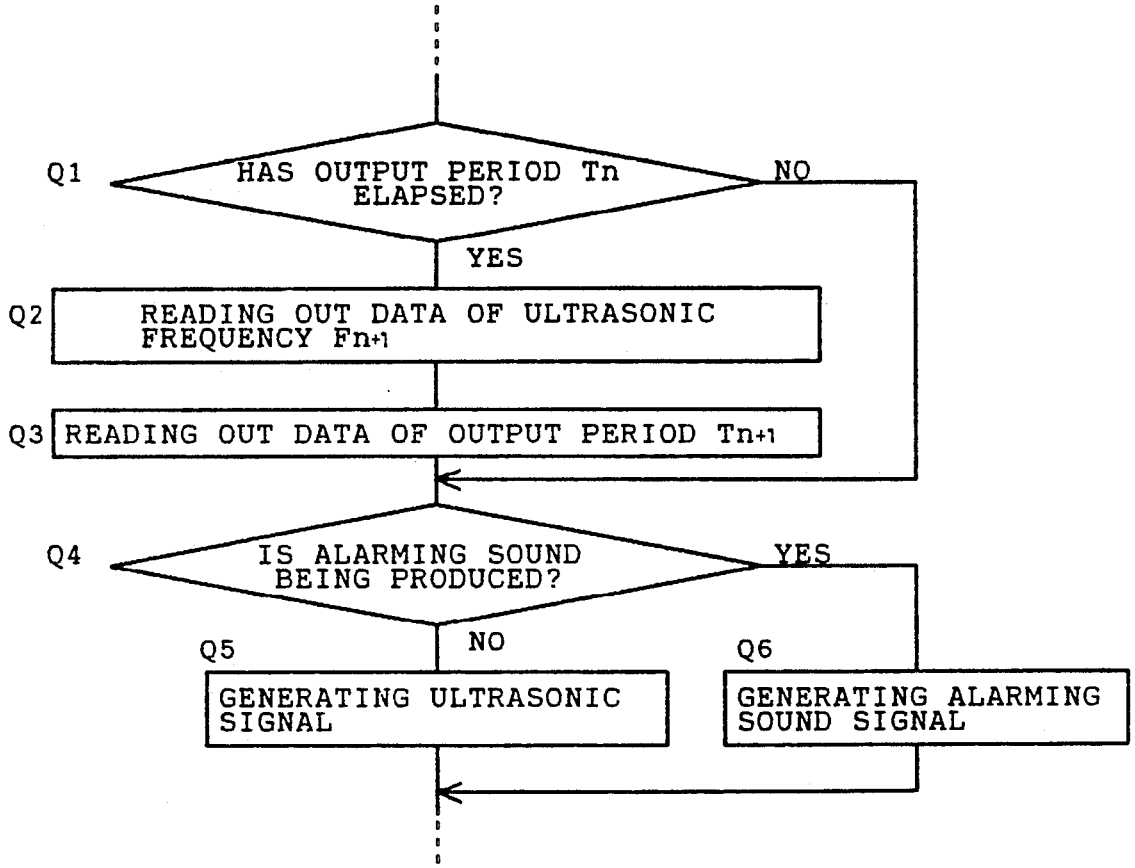
FIG. 12 is a flowchart explaining an operation for selectively producing an alarming sound or the ultrasonic waves in the third embodiment.

When the frequency and the time period are set to the respective values of $F_7$ and $T_7$ as described above, the microcomputer 16 generates at the output terminal C the buzzer-driving pulse signal in the period other than that of the alarming operation by the buzzer 19, in the same manner as described above, thereby driving the buzzer 19 so that the ultrasonic waves are generated. Thereafter, the microcomputer 16 counts the driving period of the buzzer 19 in the condition that the ultrasonic waves are being generated by the same. The microcomputer 16 further executes the program as shown in FIG. 12, performing the processing of the cooking program or the like. More specifically, the microcomputer 16 determines at step Q1 whether the time period $T_7$ (34 hours) read out at step P6 has elapsed or not. Determining that the time period $T_7$ has elapsed, the microcomputer 16 advances to steps Q2 and Q3, where the microcomputer 16 reads out and sets the data of the frequency $F_8$ and the time period $T_8$ corresponding to the count value "8" succeeding to the above-described count value "7." The microcomputer 16 then determines at step Q4 whether the alarming operation is being performed by the buzzer 19 or not. Determining that the alarming operation is being performed by the buzzer 19, the microcomputer 16 operates the buzzer 19 so that the alarming sound is produced. Determining that the alarming operation is not being performed, the microcomputer 16 advances to step Q5 with the frequency maintained at the value of $F_7$.

The above-described output state of the buzzer 19 will be described with reference to FIG. 14. For example, the ultrasonic waves are produced at the initial frequency of $F_7$ by the buzzer 19. The timing then comes for output of the alarming sound by the buzzer 19 before lapse of the output time period $T_7$ or in the period $T_{A1}$. In this case, determining at step Q4 that the alarming sound is being produced by the buzzer 19, the microcomputer 16 supplies the transistor 20 with the alarming pulse signal so that the audible alarming sound is produced from the buzzer 19 (in the period $T_{A2}$). Upon lapse of the output period of the alarming sound by the buzzer 19, the microcomputer 16 again supplies the transistor 20 with the pulse signal at the frequency of $F_7$ so that the ultrasonic waves are generated by the buzzer 19, thereby driving the same (in the period $T_{A3}$). The microcomputer 16 answers in the affirmative at step Q1 upon lapse of the output period $T_7$ and then, operates so that the ultrasonic waves are generated by the buzzer 19 at the succeeding frequency $F_8$ (in the period $T_{A4}$).

The microcomputer 16 thus repeats the steps Q1 through Q6 so that the frequency of the ultrasonic waves generated by the buzzer 19 is varied among the random values in TABLE 1 in sequence. Accordingly, the sequentially varied frequency of the ultrasonic waves can prevent the insects such as the cockroaches from being inured to the ultrasonic waves and from getting the ability to resist the ultrasonic waves.

In accordance with the third embodiment, the ultrasonic waves are generated at the random frequencies by the buzzer 19 in the period other than that of production of the alarming sound therefrom. The frequency of the ultrasonic waves is randomly varied every time the set time period for each frequency elapses. Consequently, the frequency of the ultrasonic waves is switched in sequence so that the insects are not inured to the ultrasonic waves to get the ability to resist the frequency of the ultrasonic waves, in addition to the effect achieved in the first embodiment. Thus, the effect of insect proof can be improved.

Furthermore, the initial ultrasonic frequency $F_n$ at the time of input of the electrical power is determined based on the count value n obtained from the counting operation of the counter from the time ($t_1$) of start of the program to the time ($t_2$) of inversion of the time-base signal. Consequently, the ultrasonic frequency can be varied every time the electrical power is input to the microwave oven, which also improves the insect proof.

Although the data of random frequency values are previously stored in the microcomputer 16 in the foregoing embodiment, a random number generator may be provided for calculating and setting the frequency and the output time period of the ultrasonic waves based on the random numbers, insteadly.

The foregoing disclosure and drawings are merely illustrative of the principles of the present invention and are not to be interpreted in a limiting sense. The only limitation is to be determined from the scope of the appended claims.

We claim:

1. A microwave oven comprising;

a) a magnetron generating microwaves which are irradiated onto food for heating the same;

b) a circuit substrate incorporating an electric circuit for driving and controlling the magnetron, the electric circuit including a microcomputer;

c) circuit means for generating both an electrical alarming signal and a high-frequency electrical signal; and d) a sound producer producing an alarming sound regarding a heating operation when supplied with the electrical alarming signal and producing ultrasonic waves for the repelling of insects when supplied with the high frequency electrical signal.

2. A microwave oven according to claim 1, further comprising control means for controlling the sound producer so that the high-frequency electrical signal is generated by the sound producer in a period of time other than a period of time of output of the electrical alarming signal.

3. A microwave oven according to claim 1, wherein the sound producer comprises a resonant cavity for the alarming sound and another resonant cavity for the ultrasonic waves, the cavities being separate from each other.

4. A microwave oven according to claim 1, further comprising time-base signal generating means for generating a time-base signal supplied to the microcomputer so that a clock function of the microcomputer is fulfilled, reset signal generating means for generating a reset signal so that the microcomputer is put into a reset-release state in association with power supply to the microcomputer, count means for counting pulses generated at predetermined intervals in the microcomputer, control means for starting a counting operation of the count means in response to the reset signal and interrupting the counting operation when a voltage level of the time-base signal is switched after generation of the reset signal, and selecting means for selecting a value of the frequency of the high-frequency electrical signal in accordance with a counted value of the count means.

* * * * *